United States Patent [19]

Russo et al.

[11] Patent Number: 5,031,084

[45] Date of Patent: Jul. 9, 1991

[54] UNIVERSAL REMODELER FRAME-IN KIT

[75] Inventors: Neil Russo, Howell, N.J.; Kingsley Chan, Mission Viejo, Calif.

[73] Assignee: Lightolier, Inc., Secaucus, N.J.

[21] Appl. No.: 460,301

[22] Filed: Jan. 3, 1990

[51] Int. Cl.[5] ..... F21S 1/02; F21V 21/04; F21V 21/14

[52] U.S. Cl. ..... 362/365; 362/148; 362/366; 362/404; 248/343

[58] Field of Search ..... 362/148, 364, 365, 366, 362/404, 418, 147, 368, 457; 248/342, 343; 52/28, 39

[56] References Cited

U.S. PATENT DOCUMENTS

| | | | |
|---|---|---|---|
| 2,787,702 | 4/1957 | Oster et al. | 362/366 |
| 2,802,933 | 8/1957 | Broadwin | 362/366 |
| 3,316,399 | 4/1967 | Totten | 362/366 |
| 3,700,885 | 10/1972 | Bobrick | 362/366 |
| 3,801,815 | 4/1974 | Docimo | 362/366 |
| 4,327,403 | 4/1982 | Capostagno et al. | 362/365 |
| 4,336,575 | 6/1982 | Gilman | 362/365 |
| 4,400,766 | 8/1983 | Munson | 362/365 |
| 4,471,416 | 9/1984 | Druffel | 362/365 |

*Primary Examiner*—Ira S. Lazarus
*Assistant Examiner*—Richard R. Cole
*Attorney, Agent, or Firm*—Hopgood, Calimafde, Kalil, Blaustein & Judlowe

[57] ABSTRACT

An adjustable mounting frame, and a kit including this frame, for mounting recessed lighting fixtures, and a method therefor. The mounting frame includes a mounting ring and spring members which can hold a lighting fixture trim in place. In addition to the mounting frame, the kit may also include fastening means for mounting the frame onto the ceiling, a junction box, an electrical conduit and/or a socket cup. The mounting method generally involves the steps of installing the mounting frame in the ceiling, and mounting the trim in the frame by inserting the trim into the spring members.

22 Claims, 3 Drawing Sheets

UNIVERSAL REMODELER FRAME-IN KIT

BACKGROUND OF THE INVENTION

This invention is related to an apparatus and a method for mounting recessed lighting fixtures in a pre-existing ceiling, and particularly to a mounting apparatus which can accommodate lighting trims of different sizes and shapes.

Recessed lighting fixtures have become increasingly popular in recent years due to their aesthetic appeal and other advantages. Such fixtures traditionally are mounted in the ceiling so that all the wiring and hardware are hidden from view from below.

Recessed lighting is sometimes installed when the ceiling is installed; when the ceiling and lighting equipment are designed together it is easy to custom fit the fixtures. However, to install recessed lighting fixtures in an existing ceiling, a mounting kit or other apparatus is needed. Generally, the installer must cut a hole in the ceiling and pass the wiring, junction box and light socket through the ceiling hole. The lighting fixture trim is then mounted in the hole.

Various mounting methods are possible. One method utilizes a mounting frame which fits against the inside periphery of the ceiling hole. The mounting frame is nailed or otherwise anchored in place and the lighting fixture trim is mounted thereon. The mounting frame is made to match the size and shape of the trim with which it is used. Alternatively, it is possible to anchor the socket cup in place above the ceiling and mount the trim thereon using straps, wires, clips, or other devices.

A severe disadvantage associated with the traditional mounting frame is that one is limited to using a frame made for the fixture being mounted; these frames cannot accommodate trims of varying sizes and shapes. This is particularly troublesome when an installer is in the field and needs to be prepared to mount a variety of lighting fixtures, or when an installer or purchaser at the time of selecting the mounting frame is unsure what size or type of trim will be mounted.

SUMMARY OF THE INVENTION

The present invention is directed to an adjustable mounting frame for mounting recessed lighting fixtures, and to a kit for mounting recessed lighting fixtures comprising said frame. The kit may also include fastening means, a junction box, an electrical conduit and/or a socket cup.

This invention is also directed to a method for mounting a recessed lighting fixture in a pre-existing ceiling, which method comprises installing the frame in the ceiling, and mounting the trim onto the mounting frame.

One object of the present invention is to provide a method and apparatus for mounting recessed lighting fixtures in pre-existing ceilings.

Another object of this invention is to provide an adjustable mounting frame for mounting lighting fixture trims.

An additional object of this invention is to provide a method and apparatus for mounting lighting trims of various shapes and sizes using the same mounting frame.

A further object of this invention is to provide a universal frame-in kit for recessed lighting fixtures which kit is suitable for use by either professional or do-it-yourself remodelers.

BRIEF DESCRIPTION OF THE DRAWINGS

FIG. 4 illustrates the arrangement of the ceiling, wiring, junction box, electrical conduit and socket cup prior to passing the junction box, cable and cup through the ceiling opening.

FIG. 5 shows the trailing end of the junction box passing through the opening and the mounting frame in position to be inserted into the opening.

FIG. 6 illustrates the mounting frame after it is mounted in the ceiling opening and the socket cup hanging from the conduit in preparation for receiving the lighting trim.

FIG. 7 shows the trim mated with the cup.

FIG. 8 depicts the lighting trim mounted in the ceiling-mounted frame.

DETAILED DESCRIPTION OF THE PREFERRED EMBODIMENTS

Figure 1:
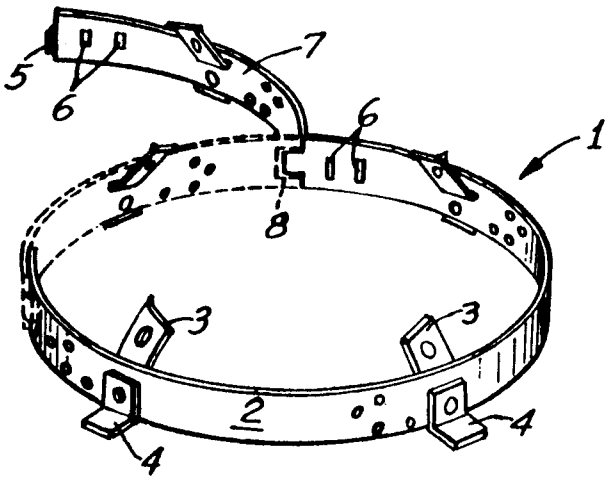
FIG. 1 depicts an adjustable mounting frame according to the present invention.
Figure 3:
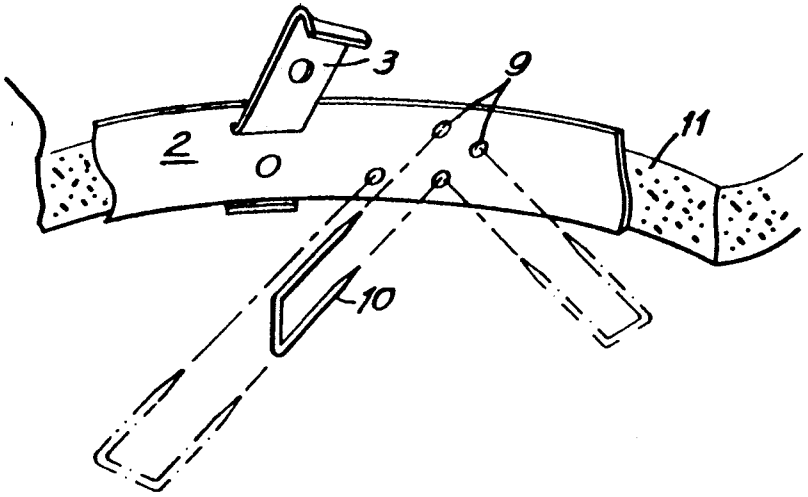
FIG. 3 is an enlarged view of a portion of the mounting frame of FIG. 1 showing a method for mounting the frame into a ceiling using nail clips.
Figure 2:
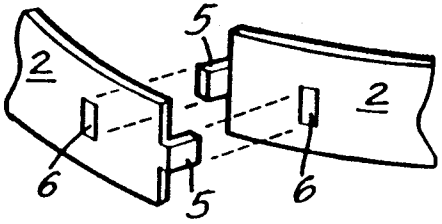
FIG. 2 is an enlarged view of a portion of the mounting frame of FIG. 1 showing how the frame tabs fit into the tab holes.
Figure 6:
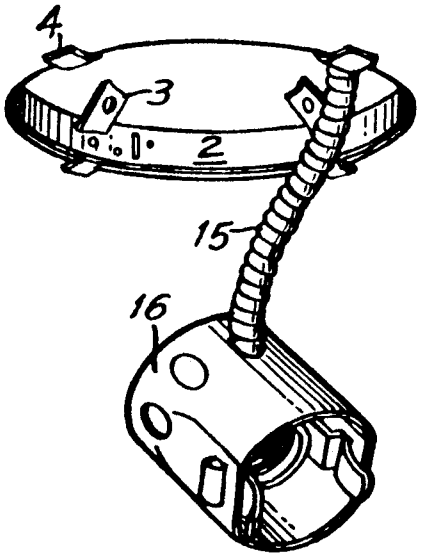
FIGS. 4–8 show in sequence a method according to the present invention, and illustrate an apparatus according to the invention.
Figure 5:
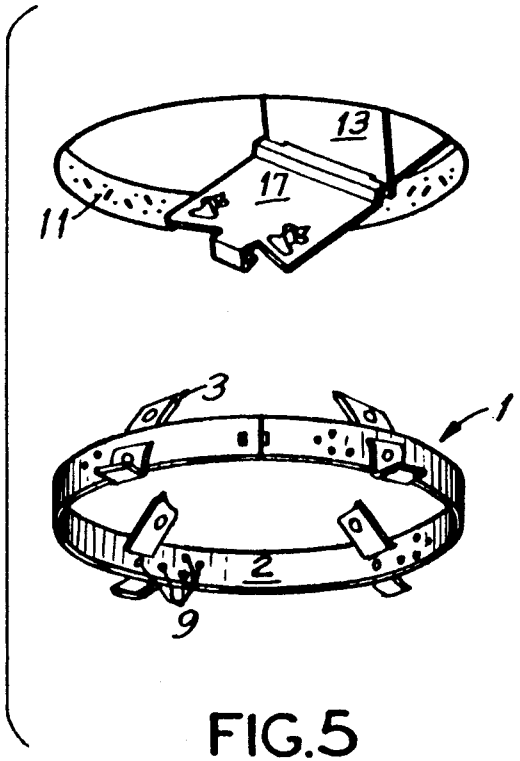
Figure 4:
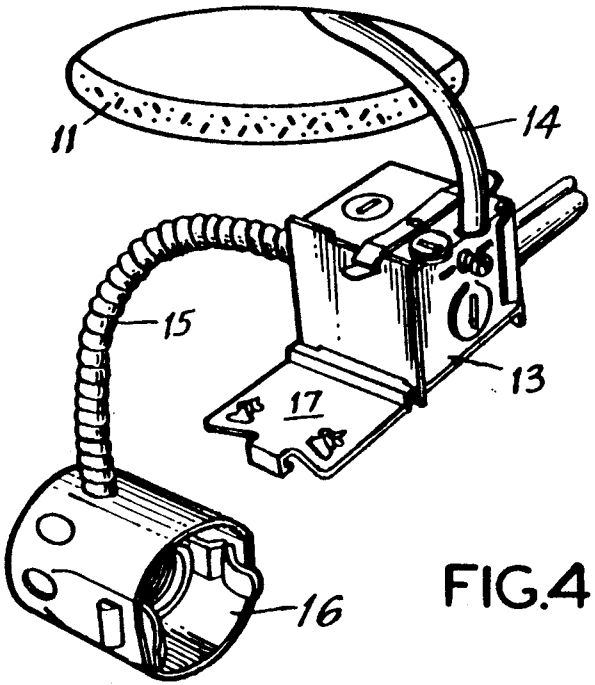
Figure 8:
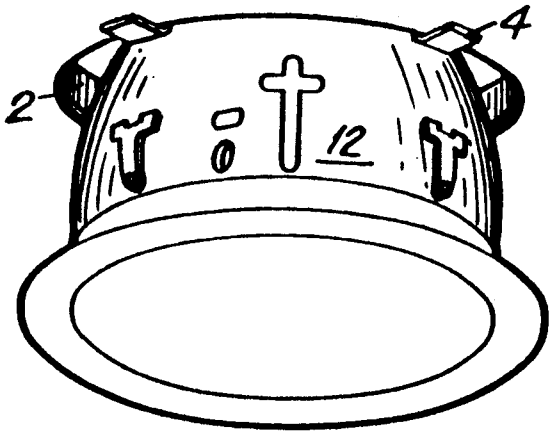
Figure 7:
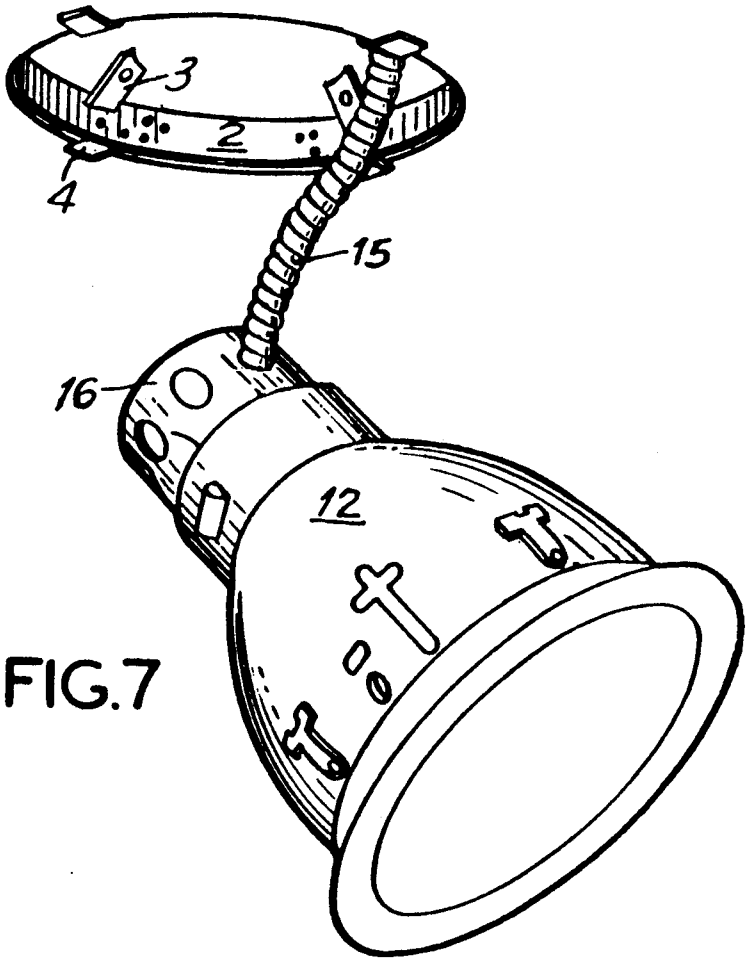

Referring to FIGS. 1–3, one embodiment of an adjustable mounting frame 1 according to the present invention is shown. The adjustable mounting frame 1 comprises a mounting ring 2 having a plurality of holes and slots. Spring members 3 including a spring ledge 4 are mounted through slots in the ring 2 and, as will be further described, cooperate with each other to support a fixture. The mounting ring 2 also comprises tabs 5 and tab slots 6 at each end which are sized and positioned so that the tabs 5 may fit tightly into the slots 6 to close the mounting ring 2.

The mounting ring 2 has a removable portion 7 at one end to allow adjustment of the size of the ring 2. The mounting ring 2 may be bent along a score line 8 until the portion 7 separates from the remainder of the mounting ring 2. This separation removes a tab 5 and tab slot 6 from the remainder of the mounting ring 2, but the remainder has another tab slot 6, and a tab 5 which may be bent for use, located at the score line 8 end of the shortened ring 2.

Ring holes 9 permit fastening means 10 to penetrate the mounting ring 2 so that the ring 2 can be mounted onto a ceiling 11 using fasteners appropriate for the ceiling material.

FIGS. 4–8 show a preferred mounting method and kit according to the present invention. An opening must be cut in the ceiling 11 to accommodate the lighting trim 12 which is to be mounted therein. A junction box 13 connects the house wiring 14 to one end of the electrical conduit 15. The other end of the conduit 15 is connected to the socket cup 16 which is to mate with the trim 12. A junction box plate 17 is attached to the box 13 for mounting purposes.

The wiring 14, junction box 13 and plate 17, conduit 15, and cup 16 are passed through the opening in the ceiling 11. Optionally, the junction box 13 and plate 17 may be fixed onto the upper surface of the ceiling by fastening means. The mounting ring 2 is then attached to the ceiling 11 inside the ceiling opening by fastening means 10; when the mounting frame 1 is properly mounted, the spring ledge 4 of each spring member 3 presses against the lower surface of the ceiling 11. The socket cup 16 is then brought down through the opening and mated with the trim 12. The entire assembly is then lifted into the mounting ring 2 and the trim 12 is pushed into the spring members 3. The friction and pressure from the spring members 3 against the trim 12 surface holds the trim 12 in place.

The fastening means 10 comprises U-shape nail clips, each of which has two pointed prongs so that each nail clip can be driven through two holes in said mounting ring 2. Nails, staples, tacks or other fastening means may be used in place of the nail clips.

In the illustrated embodiment, four spring members are equally spaced around the mounting ring; after separation of the removable portion, the shortened ring has three spring members. The number of spring members may vary, although at least two, and preferably three or more, are needed to secure the trim. The flexibility of the spring members allows trims of varying sizes and shapes to be accommodated by the same mounting frame. Where greater adjustments are needed, the mounting ring size may be changed by breaking off the removable portion of the mounting ring before mounting the frame. A mounting frame according to the present invention may include more than one removable ring portion to allow a variety of adjustments.

Other adjustment methods are also within the scope of this invention. For example, the mounting ring may comprise several alternate tab slots for one or more tabs so that the mounting ring size may be altered without breaking off a portion, or the mounting ring may have a slidable adjustment section, or any combination of these arrangements may be used.

Although the mounting frame shown and described comprises tabs and tab slots, any suitable means may be employed to close the mounting ring. For example, the tab/slot arrangement may be replaced by clips, snaps, ties, or any other means known in the art.

The mounting frame of this invention may be made of any suitable material or combination of materials such as, for example, metals, alloys, plastics, wood, or composites. Preferably the mounting frame is made of metal; the mounting ring is most preferably steel, while the spring members are most preferably spring steel or stainless steel.

The junction box, junction box plate, conduit, and socket cup used in practicing this invention are well-known in the art.

Virtually any lighting trim may be mounted using the adjustable mounting ring of this invention. The only requirements are that the trim fit inside the mounting ring and that the trim is of such weight, shape, and surface material that the spring members will grip the outer trim surface strongly enough to support the trim weight. Since the number and size of the spring members, and the size of the ring, may vary to accommodate trims of different weights, shapes, and materials, the applicability of mounting frames according to this invention is essentially universal.

The method and apparatus of this invention may be used in ceilings of varying thickness and material. However, the ceiling must be of sufficient thickness and strength to hold the lighting fixture. Where very thin, weak ceilings exist, it may be necessary to hang the fixture from above.

Although particular embodiments of the present invention have been shown and described, the invention is not limited thereto, but includes all methods and apparatus within the scope of the appended claims and consistent with the foregoing disclosure and the attached drawings.

We claim:

1. An adjustable mounting frame for mounting a recessed lighting fixture in a ceiling comprising:

a mounting ring;

a means for adjusting and closing said ring; and a plurality of spring members mounted on said mounting ring, each said spring member extending inwardly from said ring and adapted to grip the surface of a lighting trim within said ring.

2. An adjustable mounting frame according to claim 1 wherein said adjusting and closing means of said mounting ring comprises tabs and tab slots sized and located to cooperatively engage at least two tabs and at least two slots to keep the ring closed.

3. An adjustable mounting frame according to claim 2 further comprising at least one removable portion, said portion adapted to separate from the remainder of said mounting frame so as to leave a tab at the separation point of the remainder.

4. A kit for mounting a recessed lighting fixture in a ceiling comprising an adjustable mounting frame according to claim 3.

5. A kit according to claim 4 further comprising: a means for fastening said mounting ring to the ceiling; a junction box; and an electrical conduit.

6. A kit according to claim 5 further comprising a socket cup adapted to be connected to an end of said conduit.

7. A kit according to claim 5 wherein said fastening means comprises a staple, nail or tack.

8. A kit according to claim 5 wherein said fastening means comprises one or more U-shape two-pronged nail clips.

9. An adjustable mounting frame according to claim 1 comprising at least three of said spring members.

10. An adjustable mounting frame according to claim 1 having a plurality of holes or slots therethrough.

11. A kit for mounting a recessed lighting fixture in a ceiling comprising an adjustable mounting frame according to claim 1.

12. A method for mounting a recessed lighting fixture in a ceiling comprising the steps of:

adjusting, closing and fastening an adjustable mounting frame to the inner periphery of an opening in the ceiling, said mounting frame comprising a mounting ring, a means for adjusting and closing said ring, at least one removable portion for separating from the remainder of said adjustable mounting frame leaving a tab at the separation point of the remainder and a plurality of spring members mounted on said ring, each said spring member extending inwardly from said mounting ring, and adapted to grip the surface of a lighting trim within said ring; and inserting said trim of said lighting fixture into said mounting frame until said spring members grip said trim.

13. A method according to claim 12 for mounting a recessed lighting fixture in a ceiling further comprising the steps of: electrically connecting a socket cup to electric wiring that extends through the ceiling opening and above the ceiling; and, attaching said socket cup to said trim.

14. A method according to claim 12 for mounting a recessed lighting fixture in a ceiling further comprising the step of adjusting said mounting frame to a size that matches the ceiling opening prior to fastening said mounting frame to the ceiling.

15. A method according to claim 14 for mounting a recessed lighting fixture in a ceiling wherein the step of adjusting said adjustable mounting frame comprises separating said removable portion from the remainder of said mounting ring at the separation point.

16. A method according to claim 12 for mounting a recessed lighting fixture in a ceiling wherein said mounting ring has holes therethrough and said mounting frame fastening step comprises driving a fastening means through said mounting ring holes and into the ceiling.

17. An adjustable mounting frame for mounting a recessed lighting fixture in a ceiling comprising:

a mounting ring;

an adjusting and closing means; and a plurality of spring members mounted on said mounting ring, each said spring member extending inwardly from said ring and adapted to grip the surface of a lighting trim within said ring; said adjusting and closing means of said mounting frame having at least two tabs and at least two tab slots, said slots sized and located to cooperatively engage said tabs to keep the ring closed; and at least one removable portion, said portion adapted to separate from the remainder of said mounting frame so as to leave a tab at the separation point of the remainder.

18. A kit for mounting a recessed lighting fixture in a ceiling comprising an adjustable mounting frame according to claim 17.

19. A kit according to claim 18 further comprising: a means for fastening said mounting ring to the ceiling; a junction box; and an electrical conduit.

20. A kit according to claim 19 further comprising a socket cup adapted to be connected to an end of said conduit.

21. A kit according to claim 19 wherein said fastening means comprises a staple, nail or tack.

22. A kit according to claim 19 wherein said fastening means comprises one or more U-shape two-pronged nail clips.

* * * * *